US011495174B1

(12) United States Patent
Xiao et al.

(10) Patent No.: US 11,495,174 B1
(45) Date of Patent: Nov. 8, 2022

(54) DISPLAY DEVICE AND DRIVING METHOD THEREOF

(71) Applicant: HIMAX TECHNOLOGIES LIMITED, Tainan (TW)

(72) Inventors: Fu-Zhi Xiao, Tainan (TW); Ching-Wen Wang, Tainan (TW); Cheng-Che Tsai, Tainan (TW); Chao-Chen Huang, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 0 days.

(21) Appl. No.: 17/520,707

(22) Filed: Nov. 7, 2021

(51) Int. Cl.
*G09G 3/32* (2016.01)

(52) U.S. Cl.
CPC ..... *G09G 3/32* (2013.01); *G09G 2310/08* (2013.01)

(58) Field of Classification Search
CPC ..... G09G 3/32; G09G 2310/08
See application file for complete search history.

(56) References Cited

U.S. PATENT DOCUMENTS

2005/0270873 A1* 12/2005 Lee ..... G09G 3/3611 365/205
2007/0139339 A1* 6/2007 Kim ..... G09G 3/3648 345/98

* cited by examiner

*Primary Examiner* — Andrew Sasinowski
(74) *Attorney, Agent, or Firm* — Winston Hsu

(57) ABSTRACT

A method and a display device are provided. The method includes: generating a plurality of timing control signals for controlling a plurality of LED driving circuits, wherein the plurality of timing control signals include a first timing control signal and a second timing control signal; allowing the first LED driving circuit to drive an $N^{th}$ scan line of a first display region at a first driving timing through the first timing control signal; and allowing the second LED driving circuit to drive an $N^{th}$ scan line of the second display region at a second driving timing that is different from the first driving timing through the second timing control signal.

16 Claims, 12 Drawing Sheets

DISPLAY DEVICE AND DRIVING METHOD THEREOF

BACKGROUND OF THE INVENTION

1. Field of the Invention

The present invention is related to a display device, and more particularly, to a driving method for driving a plurality of light-emitting diodes (LEDs) of a display device (e.g. micro LED display) to be turned on in different timings.

2. Description of the Prior Art

In the LED display device, two terminals of each LED are connected to a data line and a scan line, respectively. An LED driver is configured to drive an area of a plurality of LEDs by a plurality of data lines and a scan lines. The driving signals of scan lines and channel lines are output by the LED driver, and the operation of the LED driver is controlled by a timing control (TCON) circuit. Taking a resolution of 480RGB×320 as an example, the LED display device can be designed to be one LED driver being configured to drive 144 data lines and 40 scan lines, such that a number of the required LED driver in a horizontal direction is 480*3/144=10 and a number of the required LED driver in a vertical direction is 320/40=8. The LED display device can be designed to be supported by 10*8=80 LED drivers (other suitable combinations are also possible), that is, the TCON circuit must output 80 sets of signals to control the current driving operation of the LED driver. Dozens of LED drivers driving the LEDs at the same time will cause too large instantaneous current, to further cause voltage drop or component damage. For example, when the 80 LED drivers drive all the LEDs on scan line 1, 144*80=11520 LEDs are driven at the same time, such that the current increases instantly. Thus, a novel driving method and associated architecture are needed without introducing any side effect or in a way that is less likely to introduce a side effect.

SUMMARY OF THE INVENTION

It is therefore an objective of the present invention to provide a driving method for driving a plurality of light-emitting diodes (LEDs) of a display device (e.g. micro LED display) to be turned on in different timings and the display device using the same.

At least one embodiment of the present invention provides a display device comprising a plurality of display regions and a timing control circuit. Each one of the plurality of display regions comprises a plurality of data lines, a plurality of scan lines, a plurality of light-emitting diodes (LEDs) arranged in a matrix and a LED driving circuit. Each one of the plurality of LEDs has two terminals electrically connected to one of the plurality of data lines and one of the plurality of scan lines, respectively. The LED driving circuit is electrically connected to the plurality of data lines and the plurality of scan lines, and configured to control driving of the plurality of LEDs. The timing control circuit is electrically connected to a plurality of LED driving circuits of the plurality of display regions, and configured to generate a plurality of timing control signals for controlling the plurality of LED driving circuits. The plurality of display regions comprise a first display region and a second display region. The plurality of LED driving circuits comprise a first LED driving circuit and a second LED driving circuit. The plurality of timing control signals comprises a first timing control signal and a second timing control signal. The first timing control signal is configured by the timing control circuit to allow the first LED driving circuit to drive an Nth scan line of the first display region at a first driving timing. The second timing control signal is configured by the timing control circuit to allow the second LED driving circuit to drive an Nth scan line of the second display region at a second driving timing that is different from the first driving timing.

At least one embodiment of the present invention provides a display device comprising a plurality of display regions and a timing control circuit. Each one of the plurality of display regions comprises a plurality of data lines, a plurality of scan lines, a plurality of light-emitting diodes (LEDs) arranged in a matrix and a LED driving circuit. Each one of the plurality of LEDs has two terminals electrically connected to one of the plurality of data lines and one of the plurality of scan lines, respectively. The LED driving circuit is electrically connected to the plurality of data lines and the plurality of scan lines, and configured to control driving of the plurality of LEDs. The timing control circuit is electrically connected to a plurality of LED driving circuits of the plurality of display regions, and configured to generate a plurality of timing control signals for controlling the plurality of LED driving circuits. The plurality of LED driving circuits comprise a first LED driving circuit. The plurality of timing control signals comprises a first timing control signal. The first timing control signal is configured by the timing control circuit to allow the first LED driving circuit to drive scan lines of a same display region at irregular driving timings.

At least one embodiment of the present invention provides a display device comprising a plurality of display regions and a timing control circuit. Each one of the plurality of display regions comprises a plurality of data lines, a plurality of scan lines, a plurality of light-emitting diodes (LEDs) arranged in a matrix and a LED driving circuit. Each one of the plurality of LEDs has two terminals electrically connected to one of the plurality of data lines and one of the plurality of scan lines, respectively. The LED driving circuit is electrically connected to the plurality of data lines and the plurality of scan lines, and configured to control driving of the plurality of LEDs. The timing control circuit is electrically connected to a plurality of LED driving circuits of the plurality of display regions, and configured to generate a plurality of timing control signals for controlling the plurality of LED driving circuits. The plurality of display regions comprise a first display region. The plurality of LED driving circuits comprise a first LED driving circuit. The plurality of timing control signals comprises a first timing control signal and a second timing control signal. The first timing control signal is configured by the timing control circuit to allow the first LED driving circuit to drive a first data line of the first display region at a first driving timing. The second timing control signal is configured by the timing control circuit to allow the first LED driving circuit to drive a second data line of the first display region at a second driving timing that is different from the first driving timing. The plurality of LEDs included in the first display region comprise a first LED and a second LED, the first LED and the second LED belong to different sub-pixels of a same pixel. The first LED has one terminal electrically connected to the first data line, and the second LED has one terminal electrically connected to the second data line.

At least one embodiment of the present invention provides a driving method applicable to a display device. The display device comprises a plurality of display regions, each comprising a plurality of data lines, a plurality of scan lines, a plurality of light-emitting diodes (LEDs) arranged in a matrix and an LED driving circuit electrically connected to the plurality of data lines and the plurality of scan lines. Each one of the plurality of LEDs has two terminals electrically connected to one of the plurality of data lines and one of the plurality of scan lines, respectively. The LED driving circuit is configured to control driving of the plurality of LEDs. The plurality of display regions comprise a first display region and a second display region. A plurality of LED driving circuits of the display regions comprise a first LED driving circuit and a second LED driving circuit. The method comprises: generating a plurality of timing control signals for controlling the plurality of LED driving circuits, wherein the plurality of timing control signals comprises a first timing control signal and a second timing control signal; allowing the first LED driving circuit to drive an Nth scan line of the first display region at a first driving timing through the first timing control signal; and allowing the second LED driving circuit to drive an Nth scan line of the second display region at a second driving timing that is different from the first driving timing through the second timing control signal.

At least one embodiment of the present invention provides a driving method applicable to a display device. The display device comprises a plurality of display regions, each comprising a plurality of data lines, a plurality of scan lines, a plurality of light-emitting diodes (LEDs) arranged in a matrix and an LED driving circuit electrically connected to the plurality of data lines and the plurality of scan lines. Each one of the plurality of LEDs has two terminals electrically connected to one of the plurality of data lines and one of the plurality of scan lines, respectively. The LED driving circuit is configured to control driving of the plurality of LEDs. The plurality of display regions comprise a first display region and a second display region. A plurality of LED driving circuits of the plurality of display regions comprise a first LED driving circuit and a second LED driving circuit. The method comprises: generating a plurality of timing control signals for controlling the plurality of LED driving circuits, wherein the plurality of LED driving circuits comprise a first LED driving circuit, the plurality of timing control signals comprises a first timing control signal; and allowing the first LED driving circuit to drive scan lines of a same display region at irregular driving timings through the first timing control signal.

At least one embodiment of the present invention provides a driving method applicable to a display device. The display device comprises a plurality of display regions, each comprising a plurality of data lines, a plurality of scan lines, a plurality of light-emitting diodes (LEDs) arranged in a matrix and an LED driving circuit electrically connected to the plurality of data lines and the plurality of scan lines. Each one of the plurality of LEDs has two terminals electrically connected to one of the plurality of data lines and one of the plurality of scan lines, respectively. The LED driving circuit is configured to control driving of the plurality of LEDs. The plurality of display regions comprise a first display region and a second display region. A plurality of LED driving circuits of the plurality of display regions comprise a first LED driving circuit and a second LED driving circuit. The method comprises: generating a plurality of timing control signals for controlling the plurality of LED driving circuits, wherein the plurality of display regions comprise a first display region, the plurality of LED driving circuits comprise a first LED driving circuit, the plurality of timing control signals comprises a first timing control signal and a second timing control signal; allowing the first LED driving circuit to drive a first data line of the first display region at a first driving timing through the first timing control signal; and allowing the first LED driving circuit to drive a second data line of the first display region at a second driving timing that is different from the first driving timing through the second timing control signal, wherein the plurality of LEDs included in the first display region comprise a first LED and a second LED, the first LED and the second LED belong to different sub-pixels of a same pixel, the first LED has one terminal electrically connected to the first data line, and the second LED has one terminal electrically connected to the second data line.

The present invention driving method and display device can control the LEDs to be turned on at different times through the timing control signal of the timing control circuit and the LED driving circuit, and through the data lines and the scan lines. Compared to the prior art design, the proposed LED driving circuit does not drive the LEDs at a same time, such that the LED driving circuit may provide current at different timings, to prevent a transient current of the LED driving circuit from being too large and to further prevent causing voltage drop or component damage.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
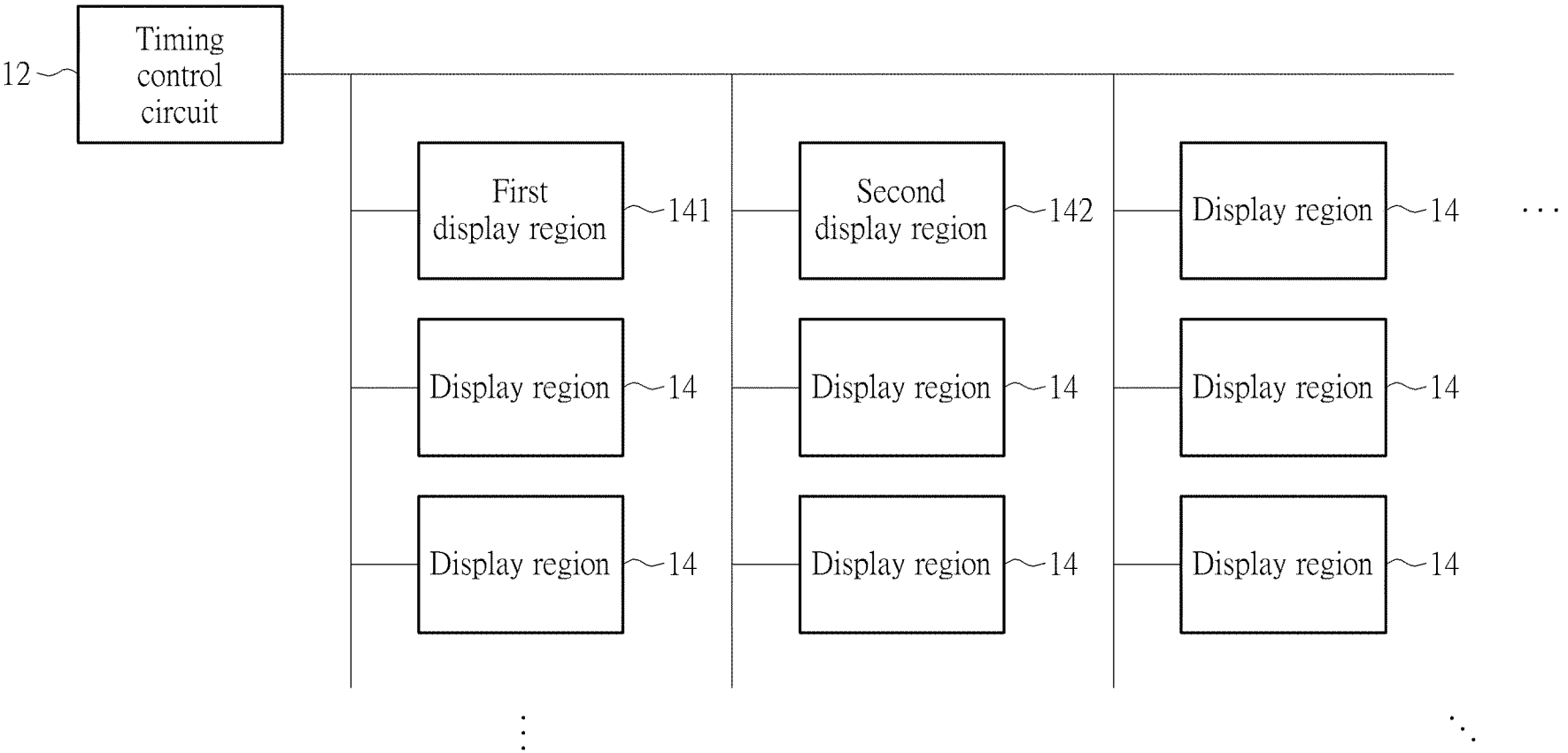
FIG. 1 is a diagram of a display device according to an embodiment of the present invention.
Figure 2:
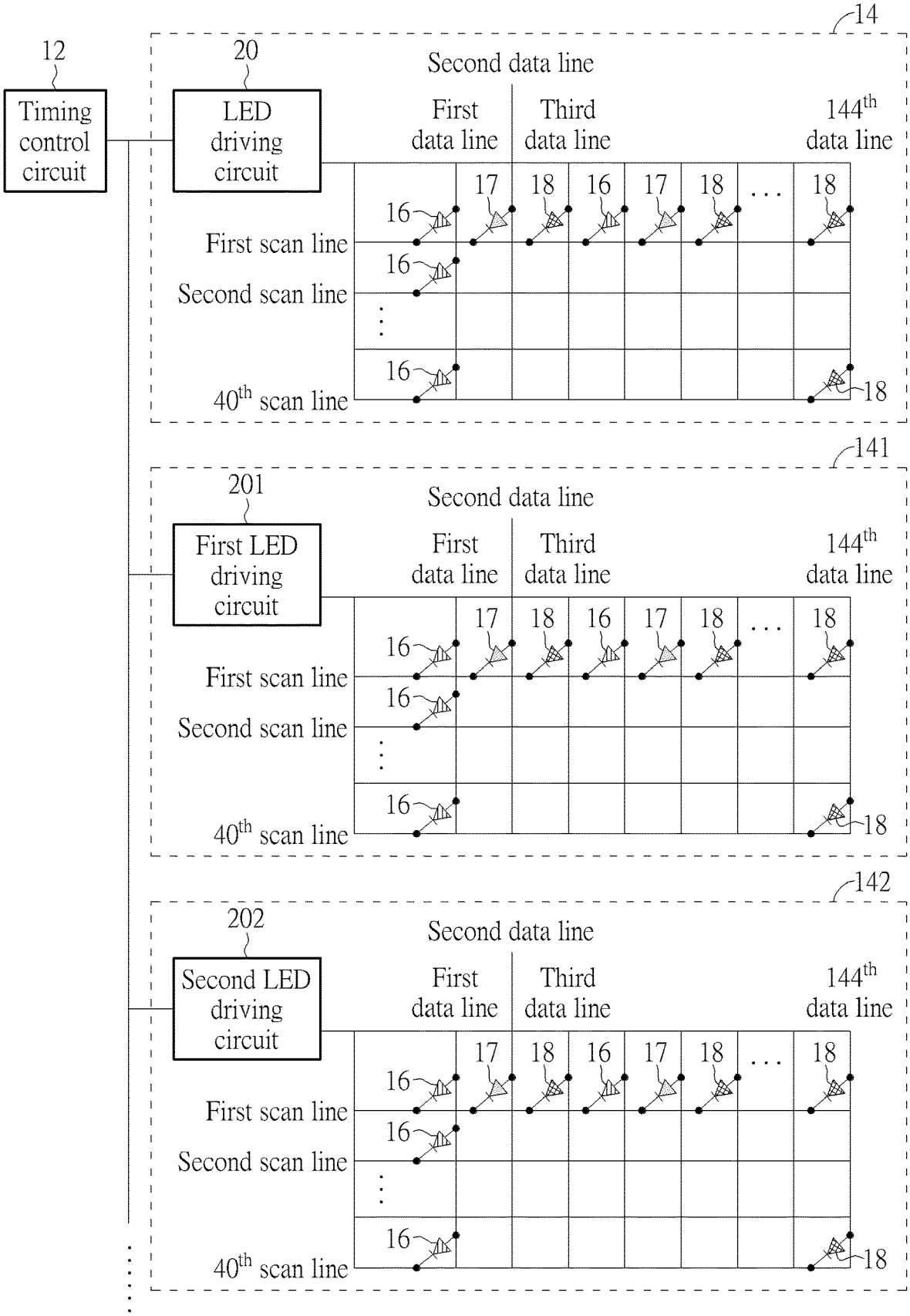
FIG. 2 is a diagram of a display region of the display device according to an embodiment of the present invention.

Please refer to FIG. 1. FIG. 1 is a diagram of a display device 10 according to an embodiment of the present invention. As shown in FIG. 1, the display device 10 comprises a plurality of display regions 14 and a timing control circuit 12. The timing control circuit 12 is electrically connected to the display regions 14, and configured to generate a plurality of timing control signals for controlling the display regions 14. In the present embodiment, the display regions 14 comprise a first display region 141 and a second display region 142, and the first display region 141 and the second display region 142 are the same display regions as the others. Please further refer to FIG. 2. FIG. 2 is a diagram of one display region 14 of the display device 10 according to an embodiment of the present invention. As shown in FIG. 2, each one of the display regions 14 comprises a plurality of data lines, a plurality of scan lines and a plurality of light-emitting diodes (LEDs) 16, 17, 18. The display device 10 shown in FIG. 1 may be a micro LED display, and each of the LEDs shown in FIG. 2 may be regarded as a sub-pixel such as one of a red (R) sub-pixel 16, a green (G) sub-pixel 17 and a blue (B) sub-pixel 18 of a pixel. The LEDs 16, 17, 18 are arranged in a matrix. Each one of the LEDs 16, 17, 18 has two terminals electrically connected to one of the data lines and one of the scan lines, respectively. As shown on FIG. 2, each LED has an anode terminal coupled to a data line and a cathode terminal coupled to a scan line.

In the present embodiment, one display region 14 has 144 data lines and 40 scan lines. The LEDs having cathode terminals coupled to the same scan line (e.g. one of $1^{st}$ scan line, a $2^{nd}$ scan line, . . . , $40^{th}$ scan line) have anode terminals coupled to a $1^{st}$ data line, a $2^{nd}$ data line, a $3^{rd}$ data line, . . . , a $144^{th}$ data line, respectively. Taking a pixel coupled to the first scan line in the display region 14 for example, a red LED 16 of the pixel is coupled to the first data line, a green LED 17 of the pixel is coupled to the second data line, and a blue LED of the pixel is coupled to the third data line.

The timing control circuit 12 is electrically connected to a LED driving circuit 20 of each display region 14, and configured to generate a plurality of timing control signals for controlling the LED driving circuit 20. In the present embodiment, the LED driving circuits 20 comprise a first LED driving circuit 201 for driving the first display region 141 (which is one of the display regions 14 in the display device 10) and a second LED driving circuit 202 for driving the second display region 142 (which is another of the display regions 14 in the display device 10). The LEDs 16, 17, 18 included in the first display region 141 comprise a first LED 161 and a second LED 171, where the first LED 161 and the second LED 171 belong to different sub-pixels of a same pixel.

Regarding driving the LEDs 16, 17, 18 at different time, the timing control signals provided from the timing control circuit 12 to the first LED driving circuit 201 comprises a first timing control signal and a second timing control signal. The scan lines comprise a first scan line to a $40^{th}$ scan line. The first timing control signal is configured by the timing control circuit 12 to allow the first LED driving circuit 201 to drive an $N^{th}$ scan line of the 40 scan lines of the first display region 141 at a first driving timing, where 1<=(not bigger than) N<=(not bigger than) 40. The second timing control signal is configured by the timing control circuit 12 to allow the second LED driving circuit 202 to drive an $N^{th}$ scan line of the 40 scan lines of the second display region 142 at a second driving timing that is different from the first driving timing.

Figure 3:
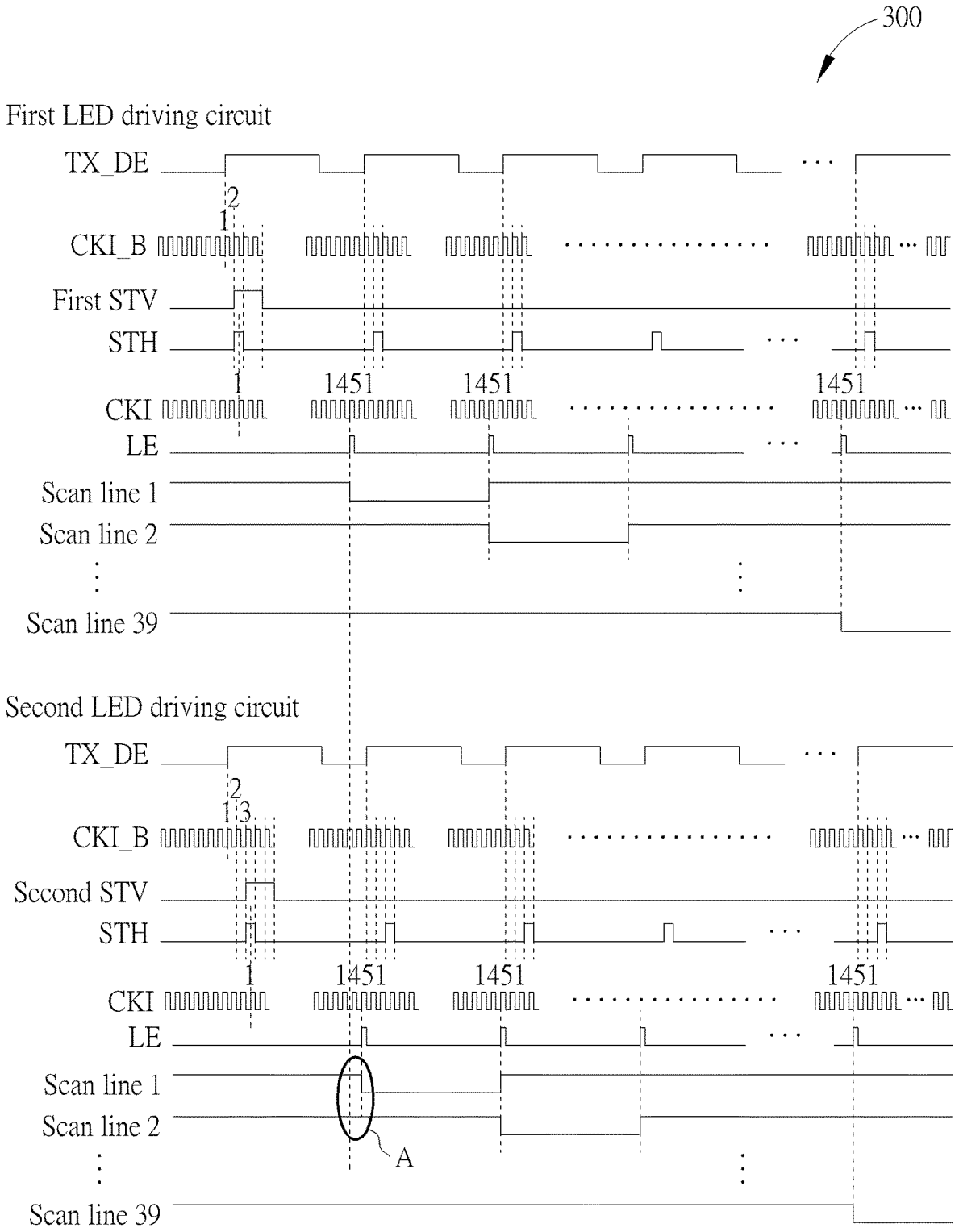
FIG. 3 is a timing chart illustrating two data-enable signals, two start vertical (STV) signals and related signals of a first LED driving circuit and a second LED driving circuit according to a first embodiment of the present invention.

For example, the timing control circuit 12 may generate different start vertical (STV) signals for the first display region 141 and the second display region 142. Please refer to FIG. 3. FIG. 3 is a timing chart 300 illustrating two data enable signals, two start vertical (STV) signals and related signals of the first LED driving circuit 201 and the second LED driving circuit 202 according to a first embodiment of the present invention. As shown in FIG. 3, the timing control circuit 12 transmits a first STV signal to the first LED driving circuit 201 and transmits a second STV signal to the second LED driving circuit 201. The timing control circuit 12 has a clock signal CKI_B which is backward from another clock signal CKI. For example, the clock signal CKI_B may be an inverse version of the clock signal CKI. In general, the STV signal is triggered by a data enable signal (labeled "TX_DE" in FIG. 3 for brevity). In the present embodiment, the timing control circuit 12 is configured to make the first STV signal have a first pulse timing and make the second STV signal have a second pulse timing different from the first pulse timing. For example, assuming that the 80 LED driving circuits are defined by "0x100[7:0]-0x14F[7:0]: driver 1-80 STV position (1T=1CKI_B)", the first STV signal may be set to "0x100[7:0]=01'h: driver 1 delay 1T" and the second STV signal may be set as "0x101[7:0]=01'h: driver 2 delay 2T" (the "driver" represents the LED driving circuit). As a result, the first STV signal is triggered after 2 pulses of the clock signal CKI_B (delay one CKI_B) since a low-to-high transition of the data enable signal TX_DE, and the second STV signal is triggered after 3 pulses of the clock signal CKI_B (delay 2 CKI_B) since a low-to-high transition of the data enable signal TX_DE. Furthermore, a start horizontal (STH) signal is triggered according to the STV signal, and a light emitting (LE) signal is triggered after 1450 pulses of a clock signal CKI since a low-to-high transition of the STH signal, and a low voltage level applied to the scan line which can turn on the LED (i.e. can allow the LED to be forward biased) depends on the LE signal. Therefore, the pulse timing of the first STV signal is one clock pulse earlier than the pulse timing of the second STV signal, such that the low voltage level of the first scan line (labeled "scan line 1" in FIG. 3 for brevity) of the second LED driving circuit 202 is one clock pulse later than the low voltage level of the first scan line of the first LED driving circuit 201 (please refer to a portion A of FIG. 3). Specifically, in the present embodiment, the timing control circuit 12 requires to have 80 STV wires connected to the 80 LED driving circuits to transmit the STV signals different from each other.

According to the above arrangement, the timing control circuit 12 is able to make the first STV signal have a first pulse timing and make the second STV signal have a second pulse timing different from the first pulse timing, and the time difference between the first STV signal and the second STV signal makes the LEDs of the first display region 141 and the LEDs of the second display region 142 be driven at different times. Therefore, the LED driving circuit 20 may provide current at different times, to prevent a transient current of the LED driving circuit 20 from being too large.

Figure 4:
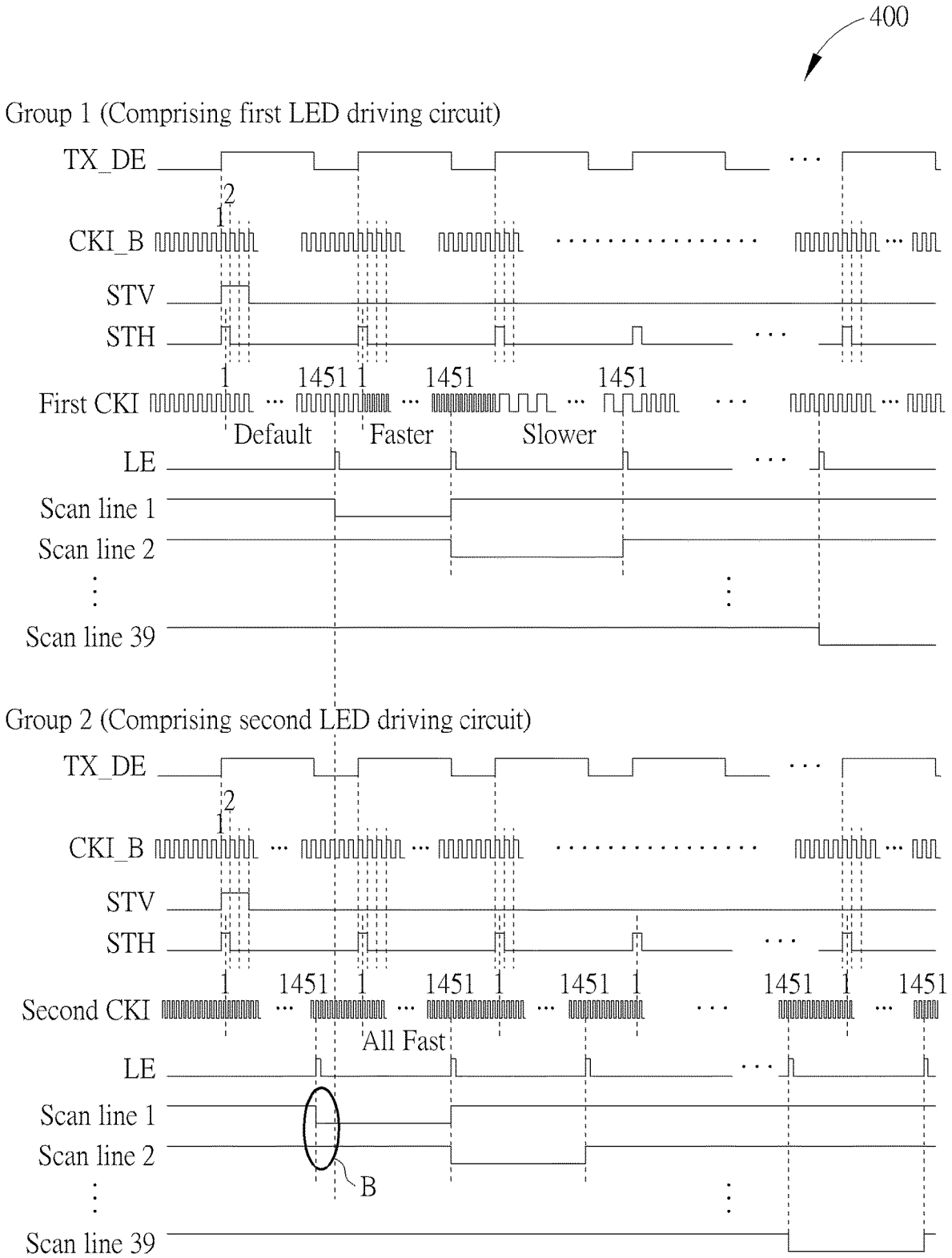
FIG. 4 is a timing chart illustrating two data-enable signals, two clock signals and related signals of a first group comprising the first LED driving circuit and a second group comprising second LED driving circuit according to a second embodiment of the present invention.

In some embodiments, the timing control circuit 12 is configured to make the first clock signal have a first frequency and make the second clock signal have a second frequency that is different from the first frequency. Please refer to FIG. 4. FIG. 4 is a timing chart 400 illustrating two clock signals and related signals of a first group comprising the first LED driving circuit 201 and a second group comprising the second LED driving circuit 202 according to a second embodiment of the present invention. In the present embodiment, the display regions 14 are divided into multiple groups, the timing control circuit 12 transmits the first clock signal to the display regions of a first group (labeled "Group 1" in FIG. 4 for brevity, and comprising the first display region 141) and transmits the second clock signal to the display regions of a second group (labeled "Group 2" in FIG. 4 for brevity and comprising the second display region 142). As shown in FIG. 4, the timing control circuit 12 transmits a first clock signal (labeled "first CKI" in FIG. 4 for brevity) to the first LED driving circuit 201, and transmits a second clock signal (labeled "second CKI" in FIG. 4 for brevity) to the second LED driving circuit 201. For example, assuming that the first clock signal is set to "Group1: scan line 1 CKI Freq. default, scan line 2 CKI Freq. Faster, scan line 3 CKI Freq. Slower; Group 2: scan line 1-40 CKI Freq. Faster," the LE signal is still triggered after 1450 pulses of a clock signal CKI since a low-to-high transition of the STH signal. Therefore, the voltage level of the second scan line of the first group turns low earlier due to a faster frequency of 1450 pulses of the clock signal before the low voltage level is applied to the second scan line, and the low voltage level of the second scan line (labeled "scan line 2" in FIG. 4 for brevity) lasts longer due to a slower frequency of 1450 pulses of the clock signal after the low voltage level is applied to the second scan line.

Furthermore, the voltage level of the first scan line (labeled "scan line 1" in FIG. 4 for brevity) of the second group turns low earlier duo to a faster frequency of all periods of the clock signal, such that the low voltage level of the first scan line of the second LED driving circuit 202 comprised in the second group is earlier than the low voltage level of the first scan line of the first LED driving circuit 201 comprised in the first group (please refer to a portion B of FIG. 4). As a result, the LED driving circuits 20 in different groups may provide current at different times, to prevent a transient current of the LED driving circuit 20 from being too large. Specifically, in the present embodiment, the timing control circuit 12 requires to generate multiple clock signals for every group.

Figure 5:
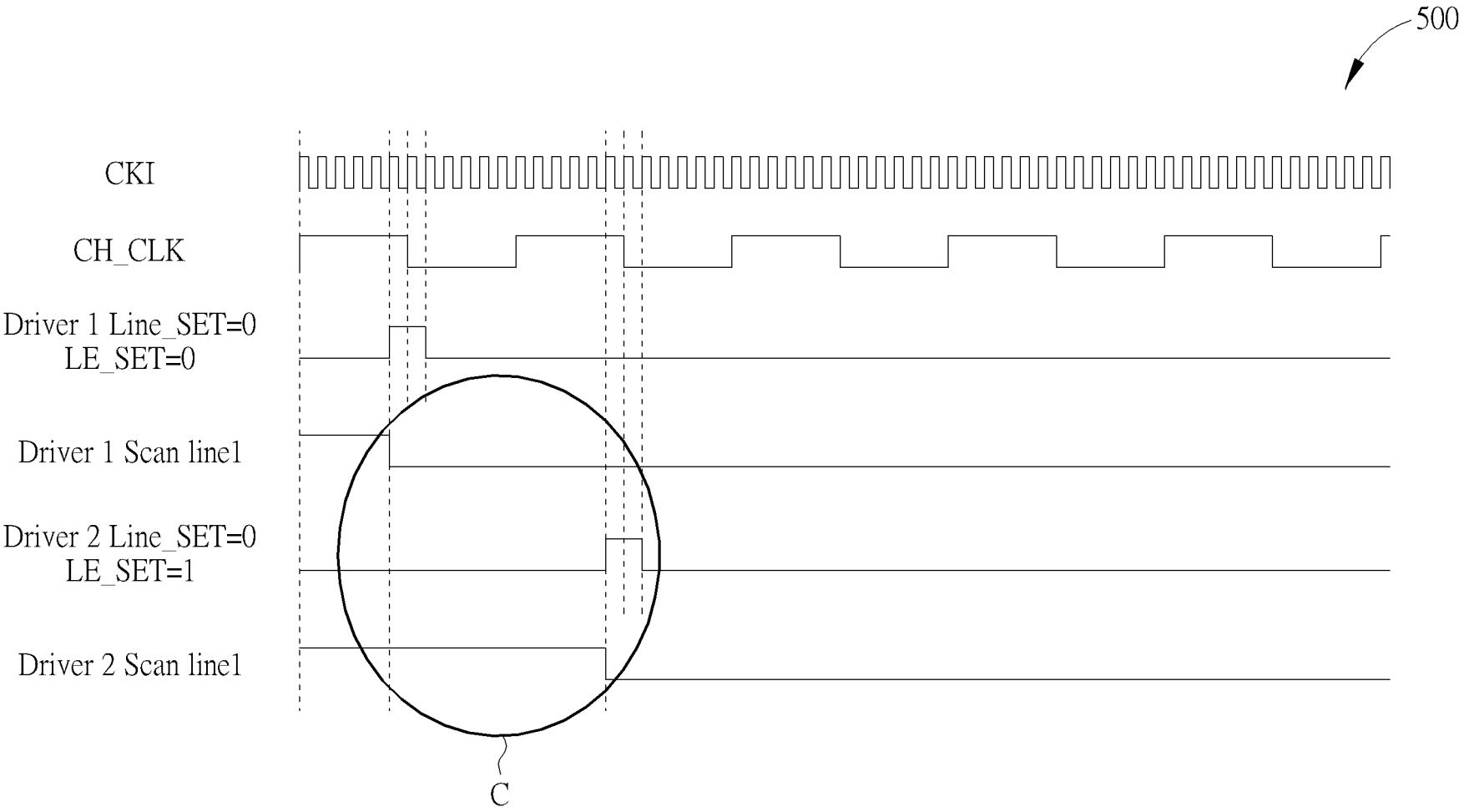
FIG. 5 is a timing chart illustrating two LE signals and related signals of the first LED driving circuit and the second LED driving circuit according to a third embodiment of the present invention.

In some embodiments, the timing control circuit 12 is configured to set a first command to instruct the first LED driving circuit 201 to generate a first light emitting (LE) signal with a first pulse timing, and set a second command to instruct the second LED driving circuit 202 to generate a second LE signal with a second pulse timing that is different from the first pulse timing. Please refer to FIG. 5. FIG. 5 is a timing chart 500 illustrating two LE signals and related signals of the first LED driving circuit 201 and the second LED driving circuit 202 according to a third embodiment of the present invention. In the present embodiment, a command of an ADC mode is utilized. The ADC mode of the LED driving circuit 20 is generally used for LED brightness compensation. In the ADC mode, internal signals of the LED driving circuit 20 can be controlled by a command. For example, a command of the ADC mode can be set with a LE signal delay header: 10111, and further be set for selecting scan line (Line_SET[6:0]), and yet further be set a starting position of the LE signal (LE_SET[6:0]). As shown in FIG. 5, assuming that a first command starts with 10111 and contents "Driver 1 Line_SET=0, LE_SET=0 and a second command also starts with 10111 and contents "Driver 2 Line_SET=0, LE_SET=1", the voltage level of the first scan line (labeled "scan line 1" in FIG. 5 for brevity) of the second LED driving circuit 202 (labeled "driver 2" in FIG. 5 for brevity) turns low later than the low voltage level of the first scan line (labeled "scan line 1" in FIG. 5 for brevity) of the first LED driving circuit 201 (labeled "driver 1" in FIG. 5 for brevity) (please refer to a portion C in FIG. 5). As a result, the first LED driving circuit 201 and the second LED driving circuit 202 may provide current at different times, to prevent a transient current of all the LED driving circuits from being too large.

Figure 6:
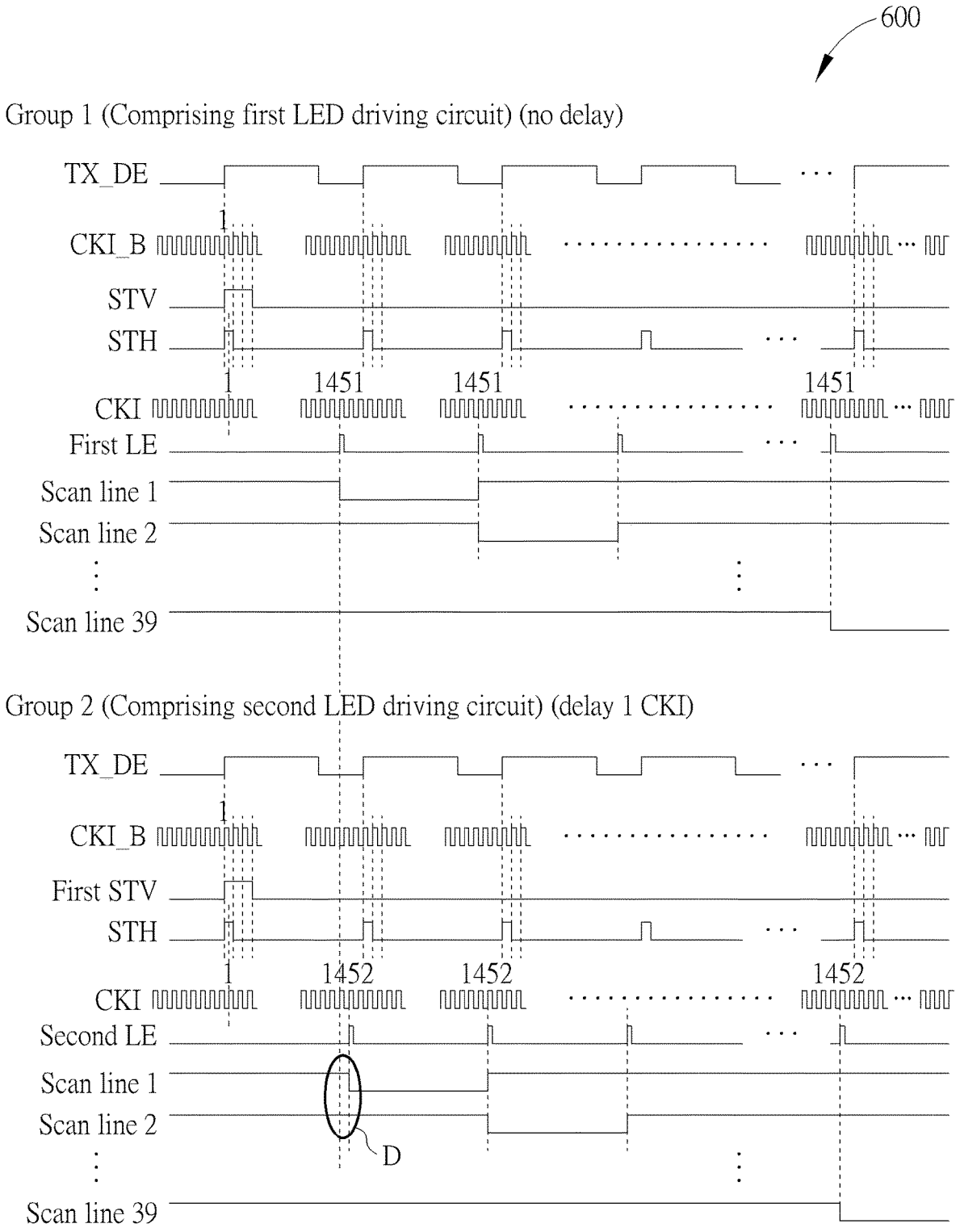
FIG. 6 is a timing chart illustrating two LE signals and related signals of the first LED driving circuit and the second LED driving circuit according to a fourth embodiment of the present invention.

In some embodiments, the first timing control signal is a first LE signal, the second timing control signal is a second LE signal, and the timing control circuit 12 is configured to make the first LE signal have a first pulse timing and make the second LE signal have a second pulse timing that is different from the first pulse timing. Please refer to FIG. 6. FIG. 6 is a timing chart 600 illustrating two LE signals and related signals of the first LED driving circuit 201 and the second LED driving circuit 202 according to a fourth embodiment of the present invention. In the present embodiment, the LE signals are generated from the timing control circuit 12, and the first LE signal is sent to the first LED driving circuit 201 of the first group, and the second LE signal is sent to the second LED driving circuit 202 of the second group. The first LE signal have a first pulse timing and the second LE signal have a second pulse timing that is different from the first pulse timing. For example, assuming that the timing control circuit 12 is set to "First Group LE counter=1451 CKI" and "Second Group LE counter=1452 CKI", the first pulse timing of the first LE signal and the second pulse timing of the second LE signal are triggered at different times. As shown in FIG. 6, the first LE signal is triggered after 1451 pulses of the clock signal CKI since a first pulse of the STH signal, and the second LE signal is triggered after 1452 pulses of the clock signal CKI since a first pulse of the STH signal. As a result, the first LE signal and the second LE signal can be set to have different trigger timings, such that the low voltage level of the first scan line (labeled "scan line 1" in FIG. 6 for brevity) of the first LED driving circuit 201 in the first group (labeled "Group 1" in FIG. 6 for brevity) is triggered earlier than the low voltage level of the second scan line (labeled "scan line 2" in FIG. 6 for brevity) of the second LED driving circuit 202 in the second group (labeled "Group 2" in FIG. 6 for brevity). Therefore, the LED driving circuits 20 may provide current at different times, to prevent a transient current of all the LED driving circuits from being too large.

Figure 7:
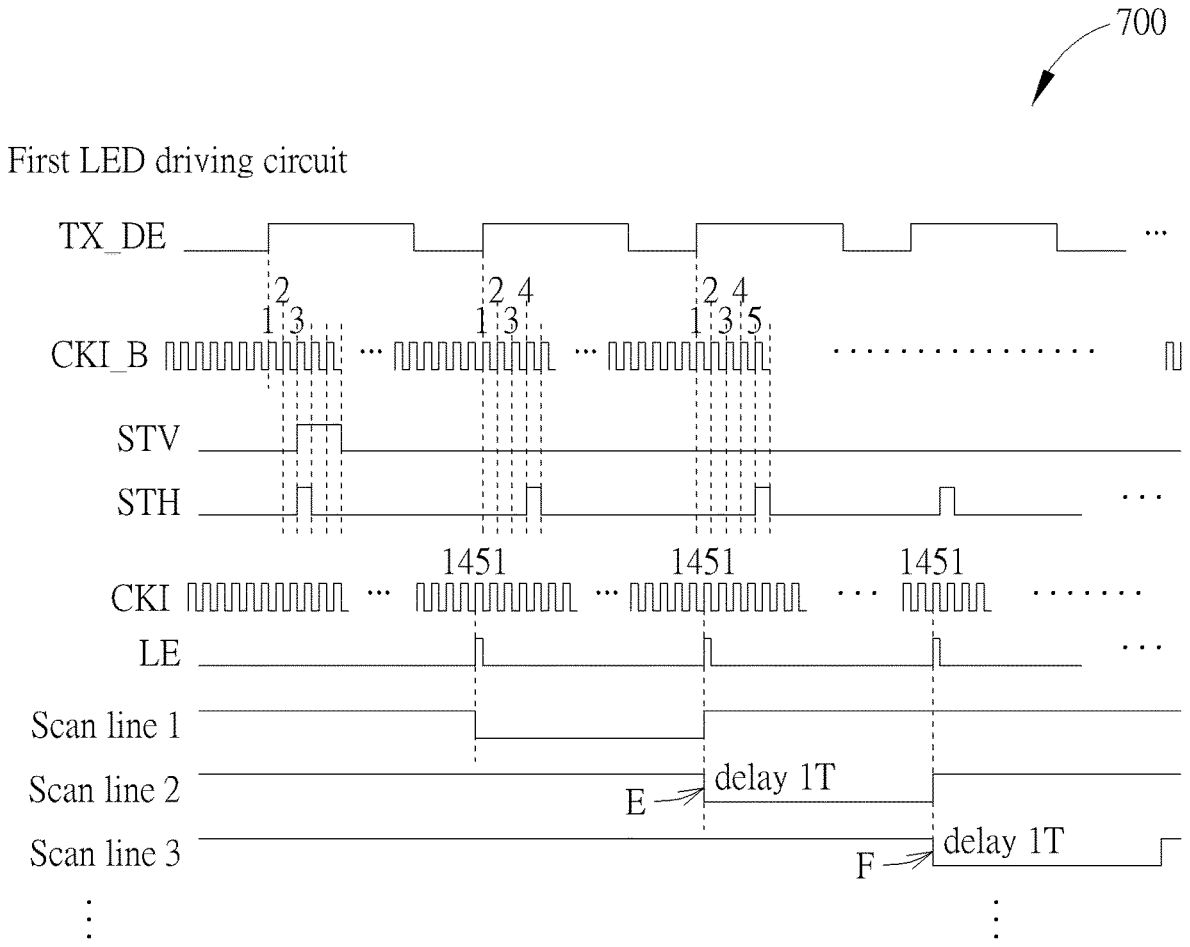
FIG. 7 is a timing chart illustrating related signals of the first LED driving circuit according to a fifth embodiment of the present invention.

In some embodiments, the timing control signals generated from the timing control circuit 12 comprise a first timing control signal, where the first timing control signal is configured to allow the LED driving circuit 20 to drive scan lines of one display region 14 at irregular driving timings. For example, the timing control circuit 12 may be configured to make the STH signal have irregular pulse timings. Please to refer FIG. 7. FIG. 7 is a timing chart 700 illustrating related signals of the first LED driving circuit 201 according to a fifth embodiment of the present invention. In general, the STV signal is triggered by a data enable signal (labeled "TX_DE" in FIG. 7 for brevity), and a STH signal is triggered according to the STV signal. In the present embodiment, the timing control signals comprise a first timing control signal that is a start horizontal (STH) signal, and the timing control circuit 12 is configured to make the STH signal have irregular pulse timings. For example, assuming that the first LED driving circuit 201 is defined by "0x150[7:0]-0x178[7:0]: scan line 1-40 STH position (1T=1CKI_B)", the STV signal may be set to "0x 100[7:0]=02'h: Driver 1 delay 2T" and the STH signals may be set as "0x150[7:0]=00'h: 1st STH delay 0T", "0x151 [7:0]=01'h: 2nd STH delay 1T" and "0x152 [7:0]=01' h: 3rd STH delay 1T" (the "driver 1" represents the first LED driving circuit). As shown in FIG. 7, the STV signal of the first LED driving circuit 201 is triggered after two pulses of a clock signal CHI_B (at a position of 3 CKI_B) since a low-to-high transition of the data enable signal due to the setting "0x100 [7:0]=02'h: Driver 1 delay 2T". A first pulse of the STH signal is triggered at the same time as the STV signal. A second pulse of the STH signal is triggered after one pulse of the clock signal CHI_B (at a position of 4 CKI_B) since a low-to-high transition of the data enable signal due to the setting "0x151[7:0]=01'h: 2nd STH delay 1T". A third STH signal is triggered after one pulse of the clock signal CHI_B (at a position of 5 CKI_B) from the data enable signal due to the setting "0x152[7:0]=01'h: $3^{rd}$ STH delay 1T". As a result, the low voltage level of the second scan line (labeled "scan line 2" in FIG. 7 for brevity) is delayed one pulse of the clock signal (please refer to a portion E in FIG. 7), and the low voltage level of the third scan line (labeled "scan line 3" in FIG. 7 for brevity) is further delayed one pulse of the clock signal (please refer to a portion F in FIG. 7). According to above arrangement, the STH signal can be set to have irregular pulse timings. Therefore, the LED driving circuits 20 may provide current at different times, to prevent a transient current of all the LED driving circuits from being too large.

In some embodiments, the timing control signals generated from the timing control circuit 12 comprise a first timing control signal and a second timing control signal, where the first timing control signal is configured to allow the first LED driving circuit 201 to drive a first data line of the first display region 141 at a first driving timing, and the second timing control signal is configured to allow the first LED driving circuit 201 to drive a second data line of the first display region 141 at a second driving timing that is different from the first driving timing. The LEDs 16, 17, 18 included in the first display region 141 comprise the first LED (e.g., red LED 161) and the second LED (e.g., green LED 171) that belong to different sub-pixels of the same pixel. The first LED 161 has one terminal electrically connected to the first data line, and the second LED 171 has one terminal electrically connected to the second data line.

Figure 8:
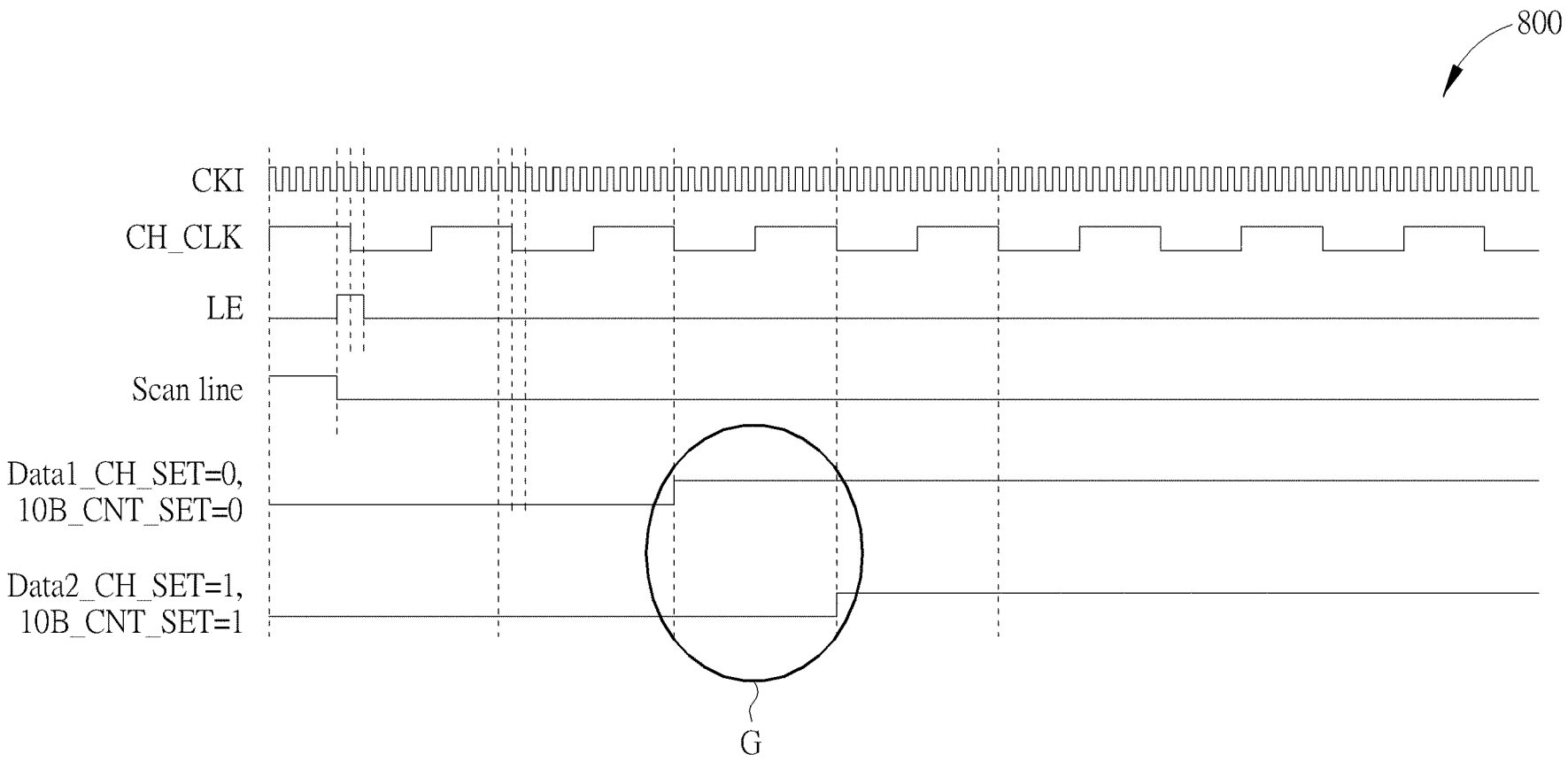
FIG. 8 is a timing chart illustrating voltage levels of the first data line and the second data line and related signals according to a sixth embodiment of the present invention.

For example, in the ADC mode, the first timing control signal is a first command, the second timing control signal is a second command, and the timing control circuit 12 is configured to set the first command to instruct the first LED driving circuit 201 to employ the first driving timing on the first data line, and set the second command to instruct the first LED driving circuit 202 to employ the second driving timing on the second data line. Please refer to FIG. 8. FIG. 8 is a timing chart 800 illustrating voltage levels of the first data line and the second data line and related signals according to a sixth embodiment of the present invention. In the present embodiment, commands of an ADC mode are utilized. Add the commands for a "10 bits counter start position" of the Data line, to control the driving timing of the data line. For example, a command of the ADC mode can be set with a driving timing delay header: 10100, and further be set for selecting one of 144 data lines (CH_SET[7:0]), and yet further be set a 10 bits counter start position (10B_CNT_SET[6:0]). As shown in FIG. 8, assuming that a scan line is already turned on by a low voltage level, and a first command starts with 10100 and contents "CH_SET=0, 10B_CNT_SET=0" and a second command also starts with 10100 and contents "CH_SET=1, 10B_CNT_SET=1", the voltage level of the first data line Data1 of the first LED driving circuit 201 turns high earlier than the high voltage level of the second data line Data2 of the first LED driving circuit 201 (please refer to a portion G in FIG. 8) for one pulse of a clock signal CH_CLK. As a result, the first LED driving circuit 201 may provide current to LEDs arranged on different data lines at different times, to prevent a transient current of all the LED driving circuits from being too large.

Figure 9:
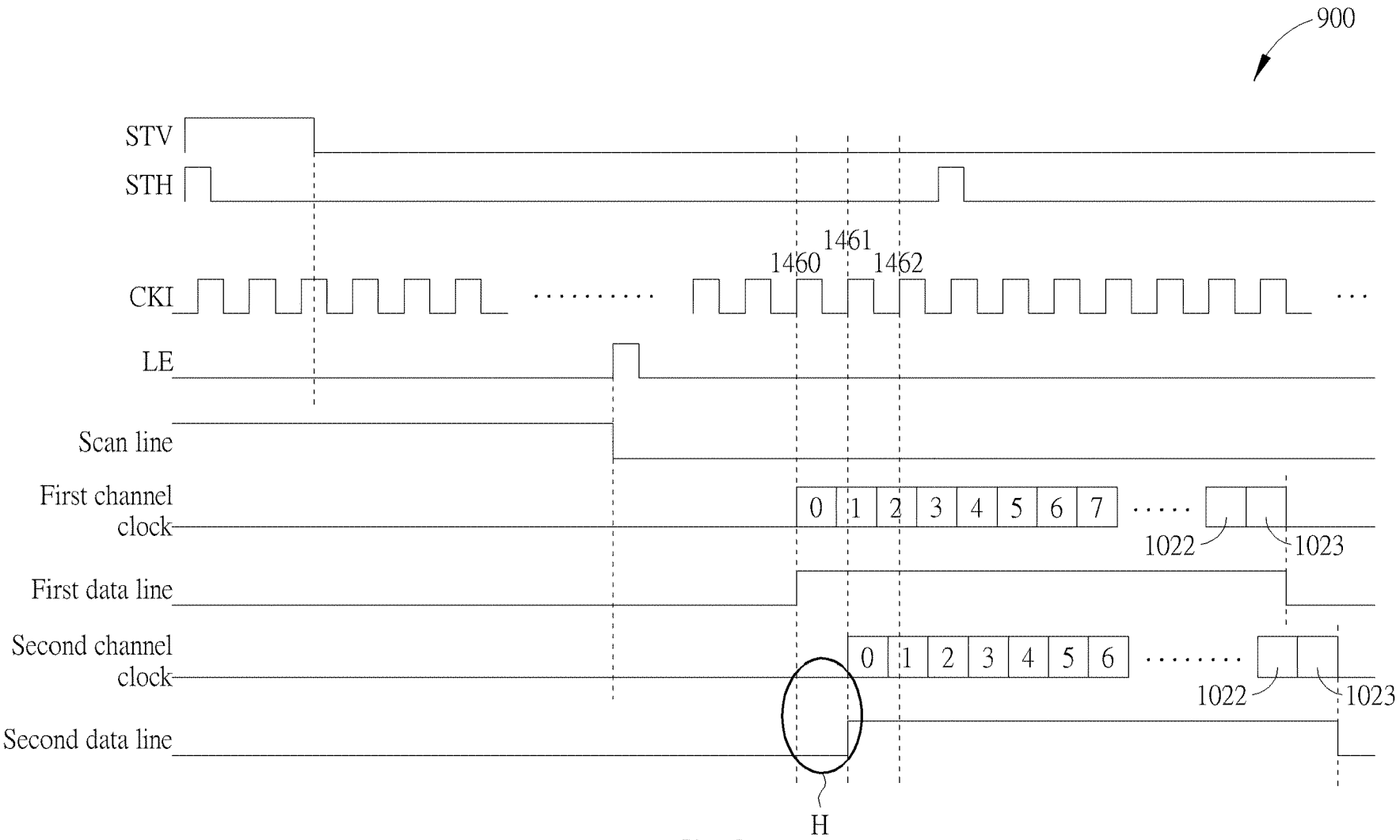
FIG. 9 is a timing chart illustrating voltage levels of the first data line and the second data line and related signals according to a seventh embodiment of the present invention.

In some embodiments, the timing control signals generated from the timing control circuit 12 comprise a first timing control signal that is a first channel clock referenced by the first LED driving circuit 201 for driving the first data line, and a second timing control signal that is a second channel clock referenced by the first LED driving circuit 201 for driving the second data line. The timing control circuit 12 is configured to set a start time of the first channel clock and set a start time of the second channel clock that is different from the start time of the first channel clock. Please refer to FIG. 9. FIG. 9 is a timing chart 900 illustrating voltage levels of the first data line and the second data line and related signals according to a seventh embodiment of the present invention. In the present embodiment, the first channel clock and the second channel clock are generated under a discontinuous mode, where a start time of the first channel clock and a start time the second channel clock are adjustable according to the clock signal CKI. For example, assuming that a scan line is already turned on by a low voltage level and the first LED driving circuit 201 is set to "First channel clock counter=1460 CKI" and "Second channel clock counter=1461 CKI", the voltage level of the first data line of the first LED driving circuit 201 turns high at the $1460^{th}$ pulse of the clock signal CKI (i.e. the start time of the first channel clock), and the voltage level of the second data line of the first LED driving circuit 201 turns high at the $1461^{st}$ pulse of the clock signal CKI (i.e. the start time of the second channel clock). As shown in FIG. 9, the voltage level of the first data line of the first LED driving circuit 201 turns high earlier than the high voltage level of the second data line of the first LED driving circuit 201 (please refer to a portion H in FIG. 9). In the present embodiment, the high voltage level of the data line is set to last 1024 pulses of the first/second channel clock. As a result, the first LED driving circuit 201 may provide current to the LEDs arranged on different data lines at different times, to prevent a transient current of all the LED driving circuits from being too large.

Figure 10:
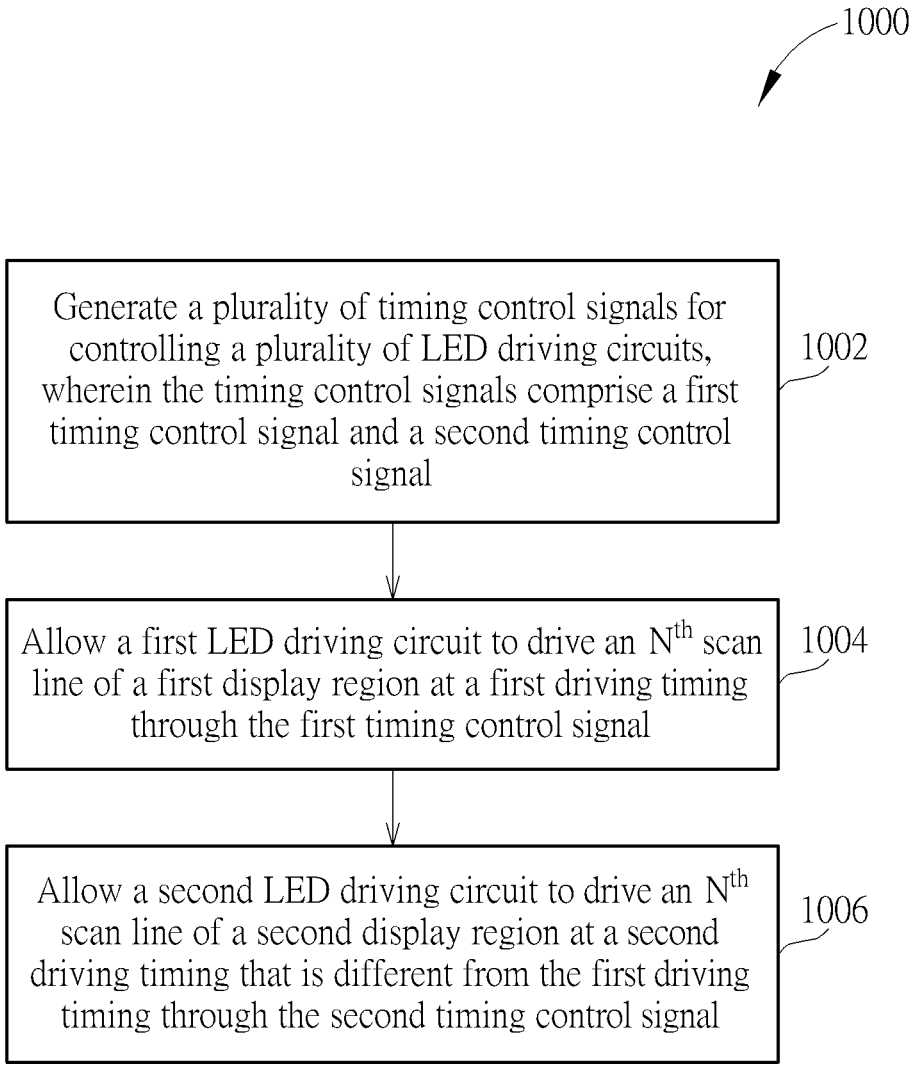
FIG. 10 is a flowchart of a first driving method for driving a plurality of LEDs of a display device to be turned on in different timings according an embodiment of the present invention.

Please refer to FIG. 10. FIG. 10 is a flowchart 1000 of a first driving method for driving a plurality of LEDs of a display device to be turned on in different timings according an embodiment of the present invention. Provided that the result is substantially the same, the steps are not required to be executed in the exact order shown in FIG. 10. The driving method 1000 of the present invention may be employed by the display device 10 shown in FIG. 1, and may comprise following steps.

Step 1002: generate a plurality of timing control signals for controlling a plurality of LED driving circuits, wherein the timing control signals comprise a first timing control signal and a second timing control signal;

Step 1004: allow a first LED driving circuit to drive an $N^{th}$ scan line of a first display region at a first driving timing through the first timing control signal; and Step 1006: allow a second LED driving circuit to drive an $N^{th}$ scan line of a second display region at a second driving timing that is different from the first driving timing through the second timing control signal.

Figure 11:
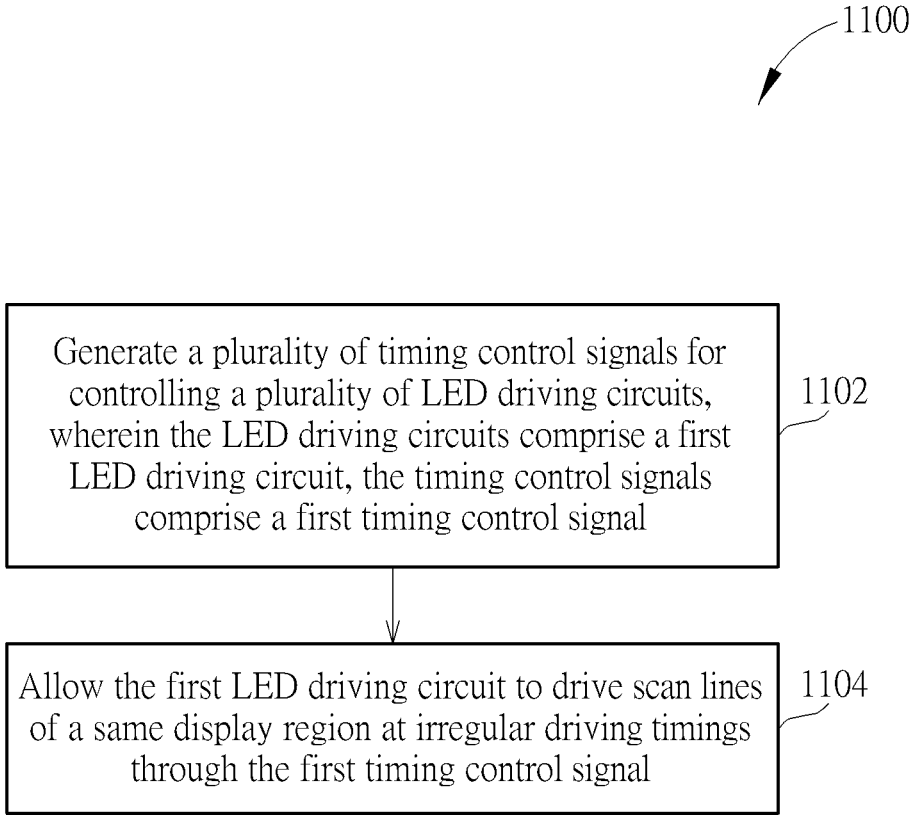
FIG. 11 is a flowchart of a second driving method for driving a plurality of LEDs of a display device to be turned on in different timings according an embodiment of the present invention.

Please refer to FIG. 11. FIG. 11 is a flowchart 1100 of a second driving method for driving a plurality of LEDs of a display device to be turned on in different timings according an embodiment of the present invention. Provided that the result is substantially the same, the steps are not required to be executed in the exact order shown in FIG. 11. The driving method 1100 of the present invention may be employed by the display device 10 shown in FIG. 1, and may comprise following steps.

Step 1102: generate a plurality of timing control signals for controlling a plurality of LED driving circuits, wherein the LED driving circuits comprise a first LED driving circuit, the timing control signals comprise a first timing control signal; and Step 1104: allow the first LED driving circuit to drive scan lines of a same display region at irregular driving timings through the first timing control signal.

Figure 12:
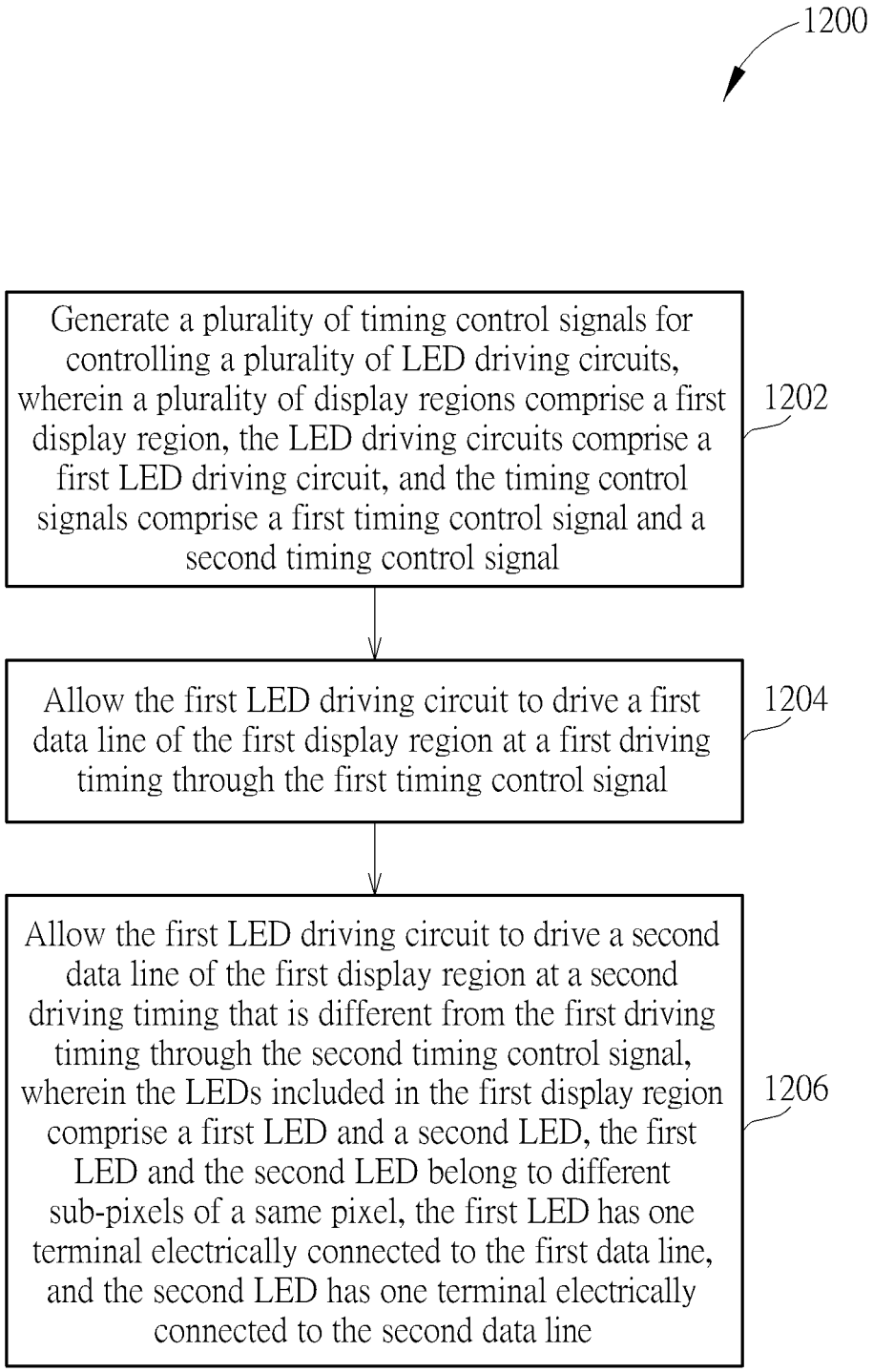
FIG. 12 is a flowchart of a third driving method for driving a plurality of LEDs of a display device to be turned on in different timings according an embodiment of the present invention.

Please refer to FIG. 12. FIG. 12 is a flowchart 1200 of a third driving method for driving a plurality of LEDs of a display device to be turned on in different timings according an embodiment of the present invention. Provided that the result is substantially the same, the steps are not required to be executed in the exact order shown in FIG. 12. The driving method 1200 of the present invention may be employed by the display device 10 shown in FIG. 1, and may comprise following steps.

Step 1202: generate a plurality of timing control signals for controlling a plurality of LED driving circuits, wherein a plurality of display regions comprise a first display region, the LED driving circuits comprise a first LED driving circuit, and the timing control signals comprise a first timing control signal and a second timing control signal;

Step 1204: allow the first LED driving circuit to drive a first data line of the first display region at a first driving timing through the first timing control signal; and Step 1206: allow the first LED driving circuit to drive a second data line of the first display region at a second driving timing that is different from the first driving timing through the second timing control signal, wherein the LEDs included in the first display region comprise a first LED and a second LED, the first LED and the second LED belong to different sub-pixels of a same pixel, the first LED has one terminal electrically connected to the first data line, and the second LED has one terminal electrically connected to the second data line.

Since a person skilled in the art can readily understand details of steps shown in FIGS. 10-12 after reading above paragraphs, further description is omitted here for brevity.

The present invention driving method and display device can control a plurality of LEDs to be turned on at different times through the timing control signal of the timing control circuit and the LED driving circuit, and through the data lines and the scan lines. Compared to the prior art design, the LED driving circuit does not drive the LEDs at a same time, such that the LED driving circuit may provide current at different timings, to prevent a transient current of the LED driving circuit from being too large and to further prevent causing voltage drop or component damage.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display device, comprising:

a plurality of display regions, each comprising:

a plurality of data lines;

a plurality of scan lines;

a plurality of light-emitting diodes (LEDs), arranged in a matrix, wherein each one of the plurality of LEDs has two terminals electrically connected to one of the plurality of data lines and one of the plurality of scan lines, respectively; and an LED driving circuit, electrically connected to the plurality of data lines and the plurality of scan lines, and configured to control driving of the plurality of LEDs; and a timing control circuit, electrically connected to a plurality of LED driving circuits of the plurality of display regions, and configured to generate a plurality of timing control signals for controlling the plurality of LED driving circuits;

wherein the plurality of display regions comprise a first display region and a second display region; the plurality of LED driving circuits comprise a first LED driving circuit and a second LED driving circuit; the plurality of timing control signals comprises a first timing control signal and a second timing control signal; the first timing control signal is configured by the timing control circuit to allow the first LED driving circuit to drive an $N^{th}$ scan line of the first display region at a first driving timing; the second timing control signal is configured by the timing control circuit to allow the second LED driving circuit to drive an $N^{th}$ scan line of the second display region at a second driving timing that is different from the first driving timing.

2. The display device of claim 1, wherein the first timing control signal is a first start vertical (STV) signal, the second timing control signal is a second STV signal, and the timing control circuit is configured to make the first STV signal have a first pulse timing and make the second STV signal have a second pulse timing different from the first pulse timing.

3. The display device of claim 1, wherein the first timing control signal is a first clock signal, the second timing control signal is a second clock signal, and the timing control circuit is configured to make the first clock signal have a first frequency and make the second clock signal have a second frequency that is different from the first frequency.

4. The display device of claim 1, wherein the first timing control signal is a first command, the second timing control signal is a second command, and the timing control circuit is configured to set the first command to instruct the first LED driving circuit to generate a first light emitting (LE) signal with a first pulse timing, and set the second command to instruct the second LED driving circuit to generate a second LE signal with a second pulse timing that is different from the first pulse timing.

5. The display device of claim 1, wherein the first timing control signal is a first light emitting (LE) signal, the second timing control signal is a second LE signal, and the timing control circuit is configured to make the first LE signal have a first pulse timing and make the second LE signal have a second pulse timing that is different from the first pulse timing.

6. A display device, comprising:

a plurality of display regions, each comprising:

a plurality of data lines;

a plurality of scan lines;

a plurality of light-emitting diodes (LEDs), arranged in a matrix, wherein each one of the plurality of LEDs has two terminals electrically connected to one of the plurality of data lines and one of the plurality of scan lines, respectively; and an LED driving circuit, electrically connected to the plurality of data lines and the plurality of scan lines, and configured to control driving of the plurality of LEDs; and a timing control circuit, electrically connected to a plurality of LED driving circuits of the plurality of display regions, and configured to generate a plurality of timing control signals for controlling the plurality of LED driving circuits;

wherein the plurality of display regions comprise a first display region; the plurality of LED driving circuits comprise a first LED driving circuit; the plurality of timing control signals comprises a first timing control signal and a second timing control signal; the first timing control signal is configured by the timing control circuit to allow the first LED driving circuit to drive a first data line of the first display region at a first driving timing; the second timing control signal is configured by the timing control circuit to allow the first LED driving circuit to drive a second data line of the first display region at a second driving timing that is different from the first driving timing, wherein the plurality of LEDs included in the first display region comprise a first LED and a second LED, the first LED and the second LED belong to different sub-pixels of a same pixel, the first LED has one terminal electrically connected to the first data line, and the second LED has one terminal electrically connected to the second data line.

7. The display device of claim 6, wherein the first timing control signal is a first command, the second timing control signal is a second command, and the timing control circuit is configured to set the first command to instruct the first LED driving circuit to employ the first driving timing on the first data line, and set the second command to instruct the first LED driving circuit to employ the second driving timing on the second data line.

8. The display device of claim 6, wherein the first timing control signal is a first channel clock referenced by the first LED driving circuit for driving the first data line, the second timing control signal is a second channel clock referenced by the first LED driving circuit for driving the second data line, and the timing control circuit is configured to set a start time of the first channel clock and set a start time of the second channel clock that is different from the start time of the first channel clock.

9. A driving method applicable to a display device, the display device comprising a plurality of display regions, each comprising a plurality of data lines, a plurality of scan lines, a plurality of light-emitting diodes (LEDs) arranged in a matrix and an LED driving circuit electrically connected to the plurality of data lines and the plurality of scan lines, wherein each one of the plurality of LEDs has two terminals electrically connected to one of the plurality of data lines and one of the plurality of scan lines, respectively, the LED driving circuit is configured to control driving of the plurality of LEDs, the plurality of display regions comprise a first display region and a second display region, and a plurality of LED driving circuits of the plurality of display regions comprise a first LED driving circuit and a second LED driving circuit, the method comprising:

generating a plurality of timing control signals for controlling the plurality of LED driving circuits, wherein the plurality of timing control signals comprises a first timing control signal and a second timing control signal;

allowing the first LED driving circuit to drive an $N^{th}$ scan line of the first display region at a first driving timing through the first timing control signal; and allowing the second LED driving circuit to drive an $N^{th}$ scan line of the second display region at a second driving timing through the second timing control signal, wherein the second driving timing is different from the first driving timing.

10. The driving method of claim 9, wherein the first timing control signal is a first start vertical (STV) signal, the second timing control signal is a second STV signal, and the method further comprises:

making the first STV signal have a first pulse timing; and making the second STV signal have a second pulse timing different from the first pulse timing.

11. The driving method of claim 9, wherein the first timing control signal is a first clock signal, the second timing control signal is a second clock signal, and the method further comprises:

making the first clock signal have a first frequency; and making the second clock signal have a second frequency that is different from the first frequency.

12. The driving method of claim 9, wherein the first timing control signal is a first command, the second timing control signal is a second command, and the method further comprises:

setting the first command to instruct the first LED driving circuit to generate a first light emitting (LE) signal with a first pulse timing; and setting the second command to instruct the second LED driving circuit to generate a second LE signal with a second pulse timing that is different from the first pulse timing.

13. The driving method of claim 9, wherein the first timing control signal is a first light emitting (LE) signal, the second timing control signal is a second LE signal, and the method further comprises:

making the first LE signal have a first pulse timing; and making the second LE signal have a second pulse timing that is different from the first pulse timing.

14. A driving method applicable to a display device, the display device comprising a plurality of display regions, each comprising a plurality of data lines, a plurality of scan lines, a plurality of light-emitting diodes (LEDs) arranged in a matrix and an LED driving circuit electrically connected to the plurality of data lines and the plurality of scan lines, wherein each one of the plurality of LEDs has two terminals electrically connected to one of the plurality of data lines and one of the plurality of scan lines, respectively, and the LED driving circuit is configured to control driving of the plurality of LEDs, the method comprising:

generating a plurality of timing control signals for controlling a plurality of LED driving circuits of the plurality of display regions, wherein the plurality of display regions comprise a first display region, the plurality of LED driving circuits comprise a first LED driving circuit, the plurality of timing control signals comprise a first timing control signal and a second timing control signal;

allowing the first LED driving circuit to drive a first data line of the first display region at a first driving timing through the first timing control signal; and allowing the first LED driving circuit to drive a second data line of the first display region at a second driving timing through the second timing control signal, wherein the second driving timing is different from the first driving timing, the plurality of LEDs included in the first display region comprise a first LED and a second LED, the first LED and the second LED belong to different sub-pixels of a same pixel, the first LED has one terminal electrically connected to the first data line, and the second LED has one terminal electrically connected to the second data line.

15. The driving method of claim 14, wherein the first timing control signal is a first command, the second timing control signal is a second command, and the method further comprises:

setting the first command to instruct the first LED driving circuit to employ the first driving timing on the first data line; and setting the second command to instruct the first LED driving circuit to employ the second driving timing on the second data line.

16. The driving method of claim 14, wherein the first timing control signal is a first channel clock referenced by the first LED driver for driving the first data line, the second timing control signal is a second channel clock referenced by the first LED driver for driving the second data line, and the method further comprises:

setting a start time of the first channel clock; and setting a start time of the second channel clock that is different from the start time of the first channel clock.

* * * * *